United States Patent [19]

Valead

[11] 4,338,728

[45] Jul. 13, 1982

[54] MASON'S GUIDE

[75] Inventor: Rick R. Valead, Phoenix, Ariz.

[73] Assignee: Castle Rock Enterprises, Phoenix, Ariz.

[21] Appl. No.: 251,578

[22] Filed: Apr. 6, 1981

Related U.S. Application Data

[63] Continuation of Ser. No. 116,354, Jan. 28, 1980, abandoned.

[51] Int. Cl.[3] ..... G01C 15/10

[52] U.S. Cl. ..... 33/406

[58] Field of Search ..... 33/404–410, 33/161, 158, 159, 294

[56] References Cited

U.S. PATENT DOCUMENTS

| | | | |
|---|---|---|---|
| 4365 | 5/1971 | Stratton et al. | 33/379 |
| 1,519,637 | 12/1924 | Shannon | 33/404 |
| 1,643,915 | 9/1927 | Angelilli | 33/408 |
| 1,897,682 | 2/1933 | Souders | 33/404 |
| 2,540,769 | 2/1951 | Wattenbarger | 33/294 |
| 2,623,289 | 12/1952 | Kampel | 33/406 |
| 2,672,691 | 3/1954 | Sears et al. | 33/406 |
| 2,788,579 | 4/1957 | Mills | 33/406 |
| 3,039,196 | 6/1962 | Jernigan | 33/406 |
| 3,096,588 | 7/1963 | Cook | 33/406 |
| 3,153,285 | 10/1964 | Senko | 33/406 |
| 3,206,854 | 9/1965 | Andrews | 33/406 |
| 3,348,312 | 10/1967 | Jones | 33/406 |
| 3,389,471 | 6/1968 | Blake | 33/406 |
| 3,520,061 | 7/1970 | Wigglesworth | 33/406 |
| 3,881,714 | 5/1975 | Wilnau | 33/406 X |
| 4,077,127 | 3/1978 | Herrington | 33/406 |

FOREIGN PATENT DOCUMENTS

| | | | |
|---|---|---|---|
| 539568 | 7/1955 | Belgium | 33/404 |
| 1498201 | 9/1967 | France | 33/404 |

*Primary Examiner*—Harry N. Haroian

*Attorney, Agent, or Firm*—Charles E. Cates; Victor Myer

[57] ABSTRACT

A mason's guide system which has at least a pair of elongate bodies that have telescoping extensions of the bodies are provided to engage a floor and ceiling. The bodies are provided with longitudinally adjustable measuring tapes and a moveable marker for precisely locating a line at the same indicia marks on the tapes.

3 Claims, 6 Drawing Figures

MASON'S GUIDE

This is a continuation of application Ser. No. 06/116,354, filed Jan. 28, 1980, now abandoned.

BACKGROUND OF THE INVENTION

This invention relates to improvements in devices used by masons to locate a guideline for a course of bricks or the like. More specifically, it relates to improvements in free-standing devices of the type indicated, called story poles.

In the prior art various types of devices for assisting the mason in properly locating his guideline for laying sequential courses of bricks have been proposed. The most common expedient in use is to build up the corners of the work and stretch a line between them. The line may be secured at either end by nails temporarily placed in the mortar or by weights such as bricks placed on either end of the line. In many cases this is entirely satisfactory, but in a significant number of instances these homely expedients are not satisfactory. Using a string as a guide one may laboriously set up by hand a precisely measured guide line for each succeeding course of bricks, but this is time consuming. Time especially in today's labor market is an expense of considerable magnitude.

More sophisticated devices called story poles have been proposed and these were some improvement. However, all of the prior art expedients were useful only for locating lines from the ground up. Many of them required complicated means for anchoring the poles to the masonry wall and none of them were adapted to aligning a row of bricks parallel to the ceiling instead of the floor, which is more desirable when the floor and the ceiling are not parallel and where, due to the sitting of the structure relative the ceiling, the eye of the observer is more likely to line up the work with the ceiling than with the floor.

An additional problem in the case of a non-parallel ceiling and floor, is the difficulty of obtaining a firm purchase on both ceiling and floor.

Particularly, in the art of building fireplaces there is a need for straight course of uniform width. This is of paramount importance because the fireplace in a home is generally the focal point of attention in the room. As the focal point of attention it is subject to critical inspection. Uneven widths of plaster in the seam between the courses which might be tolerated in a wall that is going to be covered up can not be tolerated in a fireplace. It must, or at least should be, uniform throughout its construction.

Therefore, there has existed a long felt need for an instrument or device which would permit precise, but nevertheless rapid, set up and adjustment of the line guide for succeeding courses of bricks.

BRIEF SUMMARY OF THE INVENTION

With the object of overcoming the problems in the prior art, I have invented an improved mason's guide which has an elongate body that carries indicia means, conveniently ruled, disposed along its length; indicia locator means adapted to longitudinal movement along said body; line attachment means carried by the locator and adapted to secure the mason's line thereto; and telescoping extensions of the body carried at both ends of the body.

Having been provided with telescoping extensions at both ends of the body, in the case of a non-parallel ceiling and floor, the device can readily be adapted to maintain the line parallel to the floor or parallel to the ceiling by adjusting the upper extensions or lower extensions as required.

Preferably, the extensions are provided with floor and ceiling engaging means which may have a gripping surface such as rubber or plastic to grip the ceiling and floor. The upper extension may be provided with an articulated joint in order to accommodate uneven surfaces occasioned by irregularities or non-parallel ceiling and floor. It has been found experimentally that the floor engaging means should be a foot that is not articulated, but rigidly connected to the extension. The foot may also be provided with means for anchoring it to the floor.

Preferably, the indicia means is moveable longitudinally on the body; and the indicia locator means is in the form of a collar slidably disposed on the body and having a sight opening with a line indicator 29 (disposed at the same height as string channel 48) defined therein to indicate the position of the string relative the ruled indicia. The indicia locator means may also carry additional means for taking up the slack in and tightening the mason's line.

My improved mason's guide ordinarily would be used in a system using pairs with the guideline stretched between the pairs. Of course, more than two may be used, as for example, in a freestanding fireplace it might be desirable to use a set of four so that a course of bricks could be laid around the entire perimeter of the fireplace after each adjustment of the indicia locator means.

DETAILED DESCRIPTION OF THE PREFERRED EMBODIMENTS

Turning now to the drawings in which a presently preferred embodiment of my invention is depicted:

Figure 1:
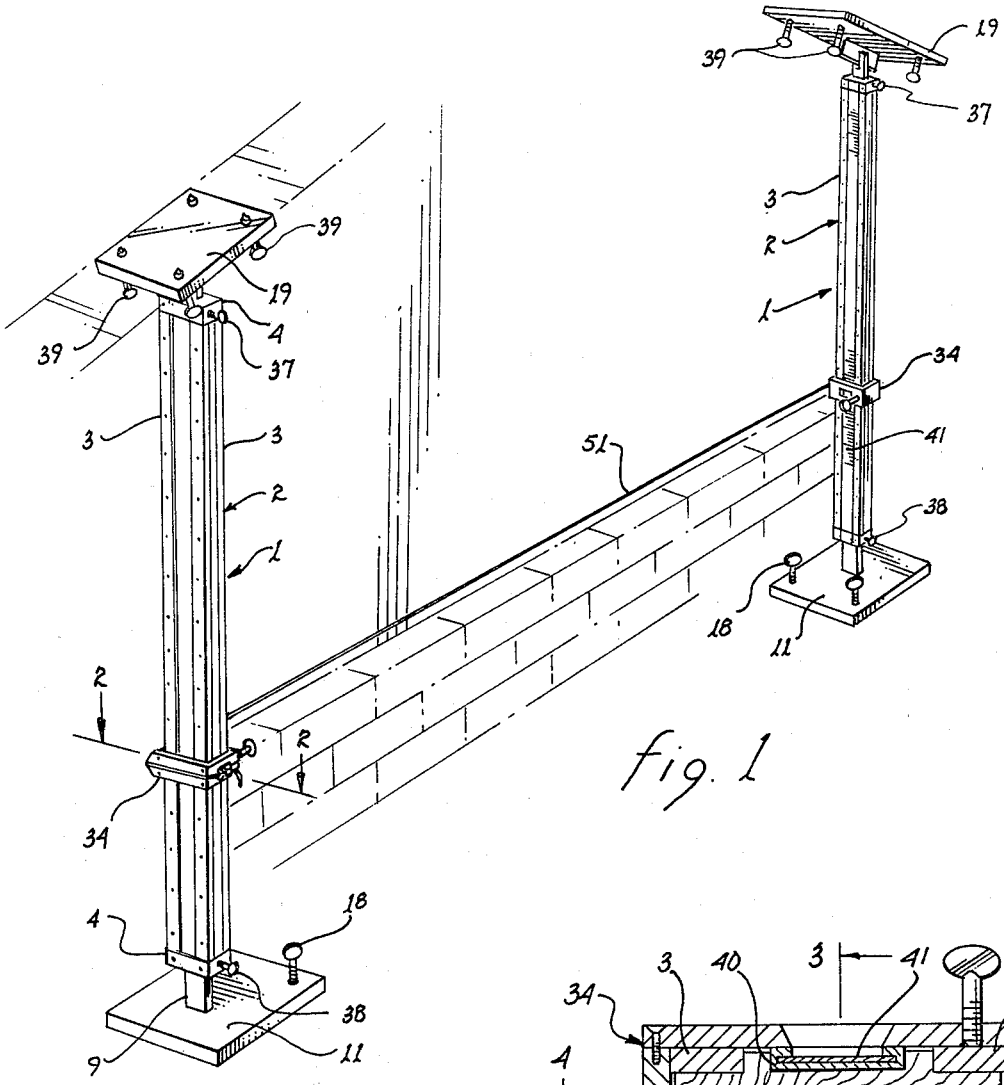
FIG. 1 is a perspective view of the device of this invention.

As seen in FIG. 1 the improved mason's guide has a body 2 which in this preferred form has aluminum wear strips 3 on the corners and aluminum bands 4 which confine the ends of the body components.

Figure 4:
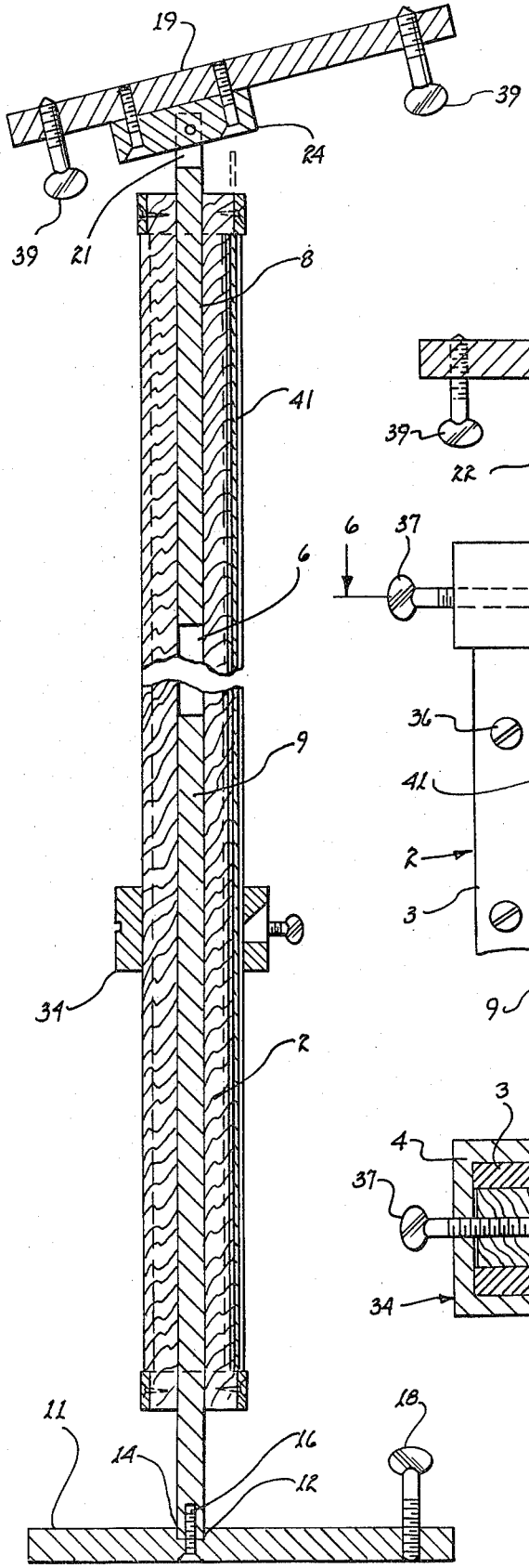
FIG. 4 is a sectional view of the device of FIG. 2 taken along the lines 4—4.

As best seen in FIG. 4 a longitudinal bore 6 is formed in the body 2. Disposed for sliding engagement in the bore 6 are upper extension 8 and lower extension 9.

To support and anchor the body 2 the lower extension 9 is fixed to a pedestal 11 broached to provide a seat 12 for the lower extension's end 14 which is secured by means of countersunk screw 16. Set screws 18 are provided as means for anchoring the pedestal.

Figure 5:
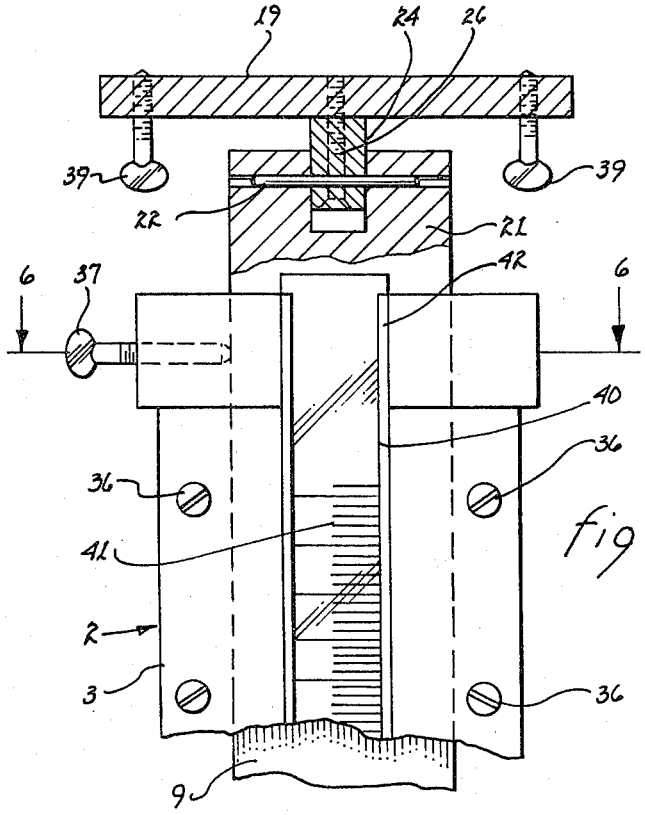
FIG. 5 is an enlarged view of a fragment of one of the poles of FIG. 1 partially in section.
Figure 6:
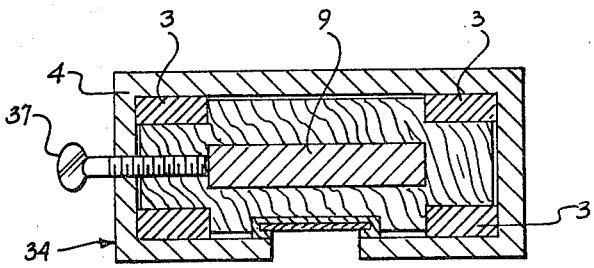
FIG. 6 is taken from the view of FIG. 5 along the lines 6—6.

Upper extension 8 is provided with a capital 19 which is pivotally attached to the upper extension by means of a clevis arrangement (as best seen in FIG. 5) wherein a fork 21 is provided and a pivot pin 22 carried by the fork pivotally engages tongue 24. The tongue in turn is attached to capital 19 by means of countersunk screw 26.

Set screws 39 pierce capital 19 and provide the means for anchoring the capital and making fine adjustments to compensate for any irregularity in the surface thereof.

The body 2 carries wear strips 3 which run longitudinally along the length of the body until they approach a point at the ends at which they jog inwardly. Thus, an aluminum retaining band disposed at each end may encompass the body and the wear strip, but remain substantially flush with the greater surface length of the wear strips.

Figure 2:
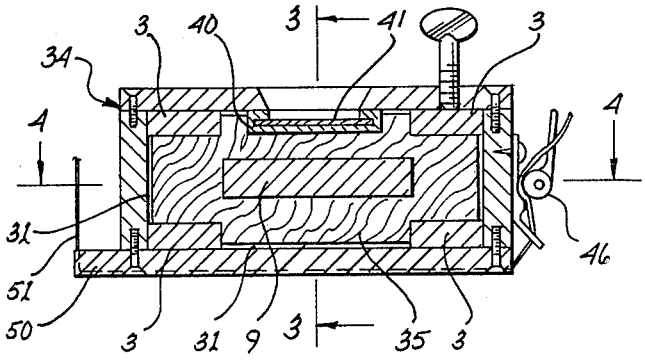
FIG. 2 is a view of one of the guides shown in FIG. 1, in section, taken along the lines 2—2.

As better seen in FIG. 2, the wear strips 3 project slightly away from the outer surface 31 of the body 2. The purpose of this clearance is to prevent the line box whose function and construction will be explained presently, from rubbing against the central portion 35 of the body 2. The central portion 35 is made of aluminum, as are the pedestal and capital and extensions in this preferred embodiment. It is to be understood, of course, that other suitable materials such as other metals and plastics can be substituted for wood and aluminum.

The wear strips 3 are attached to the central portion 35 of the body by means of countersunk screws 36 placed at intervals placed along the length of the wear strips. Set screws 37, 38 pierce the aluminum retaining band 4 and central portion 35 of the body to fix (when tightened) upper and lower extensions 8, 9 respectively in any selected positions.

Inset into one face of the body is a channel 40 in which travels a steel measuring tape 41. The tape is closely confined in the channel, but may be adjusted longitudinally. As best seen in FIG. 5, it may be moved past the end of the body in either direction to accommodate the requirements of a particular job. To that end the aluminum retaining band 4 is also provided with an extension 42 of the channel 40.

Figure 3:
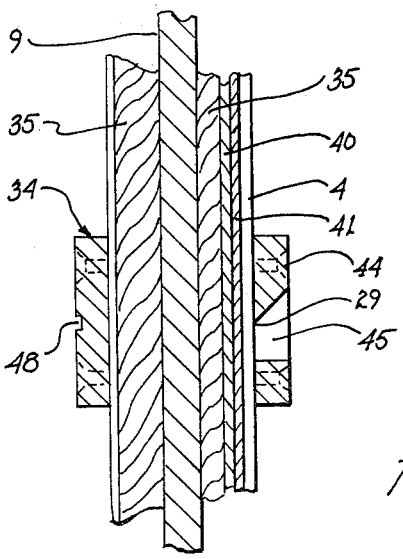
FIG. 3 is a view of the pole of FIG. 2 taken along the lines 3—3.

Referring now to FIGS. 2 and 3, the line box 34 which may be made of any suitable material (made here of aluminum) forms a longitudinally slidable collar around the body 2. The collar 44 is provided with a sight opening 45 on the side that would otherwise cover the tape 41.

A string set 46 is carried on the second side of the line box. On a third side, which is opposite the side in which the sight opening 45 is carried, a string channel 48 is provided. It has a projection 50, the function of which is to give the string or line 51 a precise departure point. The string set 46 is made by Homecraft as an off-the-shelf item which can be purchased in hardware and department stores.

In use, at least a pair of guides 1 are used with a line 51 set between them.

Operation

In a typical utilization of a set of mason's guides for the construction of a fireplace in an existing building, the pedestals of the pair of guides will be set beyond the ends of a proposed fireplace wall, and the upper and lower extensions will be extended sufficiently to brace the pedestal and capital between floor and ceiling.

When the proper extension is made, set screws 37, 38 will be tightened on upper and lower extensions respectively. The pedestal will be anchored by tightening set screws 18 and the capital will be adjusted by tightening set screws 39.

Inasmuch as ceiling and floor may not be parallel, a decision usually will be made to align the wall parallel with the ceiling because the eye of the viewer tends to make the comparison between the lines of the wall and the ceiling rather than the lines of the wall and the floor. This may require some adjustment of the measuring tape 41 on one of the guides. When this has been done the line-box carried by each body will be set on the same numerical indicia on the tape. A course of brick is laid and the line-boxes are adjusted upward to new identical settings, again on the same indicia of measurement on each tape.

Once the adjustment for tape on one of the line-boxes is made, it will not thereafter be necessary to adjust the tape further for that particular operation. Inasmuch as it is possible to adjust both tapes upwardly or downwardly, it is seldom necessary to adjust either tape more than an inch or so to achieve the proper compensation for skewed ceiling and floor lines.

Using the apparatus of this invention one can be assured that each course is straight and that each joint is of the same width, and the need for making up a course with wider or thinner joints is avoided.

The remarkable savings in time that may be accomplished by using the device of this invention can be appreciated from the following examples:

EXAMPLE I

In the construction of the home fireplace six feet long and eight feet high, slightly over three hours was required to put in a brick face that normally would take seven hours using conventional apparatus. The approximate savings was $115 for labor.

EXAMPLE II

In the construction of a fireplace fourteen feet wide and eight feet high with a twelve foot hearth, approximately five hours was required to build a fireplace structure that would normally require ten hours. The savings in labor was approximately $200.

While the principles of the invention have now been made clear in a presently preferred illustrative embodiment, it will occur to those skilled in the art that modifications of structure arrangement, proportions and materials of construction may be made with the assistance of the teachings of this specification for a specific environment in operating requirements without departing from those principles or the spirit of the invention.

The scope of the invention is to be limited only by the appended claims in which what is claimed is:

1. A mason's guide system comprising at least two elongated rectangular bodies having indicia means longitudinally and adjustably disposed thereon; indicia locator means carried by each said body and adapted to longitudinal movement along said indicia means; line attachment means carried by each said locator means for securing a mason's line between said bodies; telescoping extensions carried by each said body interiorly and at both ends thereof having means for engagement with a floor and ceiling; said engagement means comprising a pedestal and a capital, respectively, at opposite ends of said extensions; said capital having screw means thereon for making fine adjustments and anchoring to a ceiling surface; said pedestal having screw means thereon for anchoring thereof to a floor surface; an articulated joint connection between said capital and the telescoping extension associated therewith; a rigid connection between said pedestal and the telescoping connection associated therewith; said indicia locator means comprises a collar slidably disposed on said body and a sight opening with a line indicator to indicate the precise position of the line relative said indicia means; and wear members attached to said rectangular bodies at the corners thereof.

2. The mason's guide of claim 1 wherein said locator means has additional means for tightening the mason's line.

3. The mason's guide of claim 1 wherein said articulated joint comprises a clevis arrangement.

* * * * *